US005516255A

United States Patent [19]

Tygard

[11] Patent Number: 5,516,255

[45] Date of Patent: May 14, 1996

[54] CLAMPING APPARATUS

[75] Inventor: Edward Tygard, McMurray, Pa.

[73] Assignee: Tygard Machine & Manufacturing Co., Washington, Pa.

[21] Appl. No.: 232,808

[22] Filed: Apr. 25, 1994

[51] Int. Cl.[6] ..... B66F 9/18

[52] U.S. Cl. ..... 414/607; 414/621; 414/623; 414/626; 414/659; 294/81.61; 294/87.1

[58] Field of Search ..... 414/607, 619–21, 414/623, 626, 659, 665–6, 672, 795.9, 796.2, 738; 294/113, 87.1, 81.61, 90; 901/49

[56] References Cited

U.S. PATENT DOCUMENTS

| | | | |
|---|---|---|---|
| 2,696,317 | 12/1954 | Toffolon | 414/607 |
| 2,699,879 | 1/1955 | Bertram | 414/621 |
| 2,761,579 | 9/1956 | Bickerstaff . | |
| 2,807,493 | 9/1957 | Ryan et al. | 294/90 |
| 3,055,521 | 9/1962 | Crampton | 414/738 |
| 3,194,422 | 7/1965 | Shinn, Jr. . | |
| 3,262,595 | 7/1966 | Seip, Jr. et al. . | |
| 3,987,905 | 10/1976 | Dechantsreiter | 414/623 X |
| 4,252,496 | 2/1981 | Williams | 414/623 |
| 4,331,320 | 5/1982 | Naruse et al. | 254/2 R |
| 4,355,936 | 10/1982 | Thomas et al. | 414/796.2 |
| 4,603,896 | 8/1986 | Vasseur et al. | 294/87.1 X |
| 4,636,131 | 1/1987 | Sinclair | 414/607 X |
| 4,714,399 | 12/1987 | Olson | 901/49 X |
| 4,911,605 | 3/1990 | Berg | 414/607 X |
| 5,088,878 | 2/1992 | Focke et al. | 414/626 X |
| 5,161,934 | 11/1992 | Richardson | 414/621 |
| 5,253,974 | 10/1993 | Williams | 414/623 |

FOREIGN PATENT DOCUMENTS

| | | | |
|---|---|---|---|
| 0277129 | 11/1964 | Australia | 414/619 |
| 0482406 | 4/1992 | European Pat. Off. | 414/609 |
| 1546406 | 2/1990 | U.S.S.R. | 294/81.61 |
| 1555259 | 4/1990 | U.S.S.R. | 294/81.61 |

*Primary Examiner*—James W. Keenan
*Attorney, Agent, or Firm*—Leydig, Voit & Mayer

[57] ABSTRACT

A clamping apparatus for lifting objects includes a frame and first and second opposing clamping arms pivotably supported by the frame about first and second parallel axes. Each clamping arm has a contact portion. A drive member is connected to the first and second clamping arms to simultaneously pivot the first and second clamping arms about the first and second axes. The height of the contact portions when spaced apart by a first separation is the same as when spaced apart by a second separation. As a result, the clamping apparatus can securely grasp both square and elongated rectangular objects.

28 Claims, 4 Drawing Sheets

CLAMPING APPARATUS

BACKGROUND OF THE INVENTION

1. Industrial Field of Use

This invention relates to a clamping apparatus for use in lifting objects such as cases of soft drink cans or bottles. More particularly, it relates to a clamping apparatus capable of lifting an entire layer of objects from a pallet.

2. Description of the Related Art

Soft drink cans and bottles are commonly shipped from factories in cardboard cases stacked on wooden pallets, which can be lifted with a fork lift. Each pallet contains a plurality of layers each containing a plurality of cases of a single type of product. For example, ten or more layers of cases may be stacked atop a single pallet.

Retailers of soft drinks frequently order less than one entire pallet of a type of soft drink. For example, a retailer may desire a half pallet of orange soda, a quarter pallet of grape soda, and a quarter pallet of ginger ale. Therefore, before soft drinks are shipped to a retailer, they are unloaded by a distributor from pallets containing a single variety and repacked as pallets containing a plurality of different varieties of soft drinks.

The process of unloading and reloading pallets of soft drink cases is usually done by hand. This is monotonous and arduous work, and often results in physical injuries to the laborers who do this work. Furthermore, manual transfer of cases between pallets is a slow process, and a typical worker can unload and reload no more than 500 cases of soft drink cans per hour. This same problem exit with many other types of products, which are shipped from factories in lots too large for a single retailer to use.

Clamping devices for use with fork lifts have been developed which can lift an entire layer of objects (such as bricks) at a time from a pallet and move the layer to a different pallet. These devices typically have four clamping arms which pivot about horizontal axes to clamp a layer from four directions at once. The clamping arms, with the layer of bricks or other objects held therebetween, can then be transferred to a new location by a fork lift. However, these conventional clamping devices are all designed for lifting layers having specific fixed dimensions and are not suitable for lifting layers of variable dimensions. For example, if a clamping device designed for lifting a perfectly square layer is used to lift an elongated rectangular layer, two of the clamping arms will grasp the layer at a different height from the other two clamping arms.

With some objects, this difference in height may not be a problem. However with cases of soft drinks, for example, a difference of a few inches between the heights where the clamping arms contact the different sides of the layer can make it impossible for the clamping arms to lift the layer. Accordingly, there is a need for a clamping apparatus which can be used to lift both square objects and elongated rectangular objects while holding all four sides of the objects at substantially the same height.

SUMMARY OF THE INVENTION

It is an object of the present invention to provide a clamping apparatus for containers which can handle objects of various shapes, including both square and elongated rectangular objects.

It is another object of the present invention to provide a clamping apparatus which can perform loading and unloading of pallets at a far higher speed than is possible by hand.

It is a further object of the present invention to provide a method of lifting an elongated rectangular object with a clamping apparatus.

A clamping apparatus according to the present invention includes a frame and first and second opposing clamping arms pivotably supported by the frame for pivoting about first and second parallel axes, respectively. The clamping arms have first and second contact portions, respectively, for grasping an object. A drive member is connected to the first and second clamping arms to simultaneously pivot the first and second clamping arms about the first and second axes. The height of the first and second contact portions is the same when the contact portions are spaced from one another by a first separation as when they are spaced by a second separation different from the first separation.

In a preferred embodiment, the clamping apparatus includes third and fourth opposing clamping arms pivotable about third and fourth parallel axes extending perpendicular to the first and second axes and having third and fourth contact portions. The height of the third and fourth contact portions is the same when the contact portions are spaced from one another by the first separation as when they are spaced by the second separation.

Because the height of the contact portions remains the same at two different separations, when the clamping apparatus is used to grasp an elongated rectangular object from four sides, all four contact portions can be at substantially the same height and so can reliably hold the object.

A method of lifting an elongated rectangular object according to the present invention includes pivoting a first clamping arm about a first axis to bring a contact portion of the first clamping arm into contact with one of the lengthwise sides of the object at a prescribed height, and pivoting a second clamping arm about a second axis perpendicular to the first axis to bring a contact portion of the second clamping arm into contact with one of the widthwise sides of the object, also at the prescribed height. The clamping arms and the object held thereby are then lifted.

A clamping apparatus according to the present invention is particularly suitable for use with a conventional fork lift. However, it can be used with any mechanism capable of raising and lowering the clamping apparatus together with a load held by the clamping apparatus.

In a preferred embodiment, the objects to be lifted by the clamping apparatus are cases of soft drink cans arranged in a square or elongated rectangular layer. However, the present invention is not restricted to use with any particular type of object, and can be used to lift bricks, lumbers, and boxes of various types of merchandise, for example. The object or objects to be lifted need not be arranged in layers, and the apparatus can be used to lift a single object, such as a single box. Furthermore, the object or objects need not have parallel sides, and could be cylindrical barrels, for example. Thus, the present invention can be used with virtually any objects which can be grasped by forces applied from four sides.

DESCRIPTION OF PREFERRED EMBODIMENTS

Figure 1:
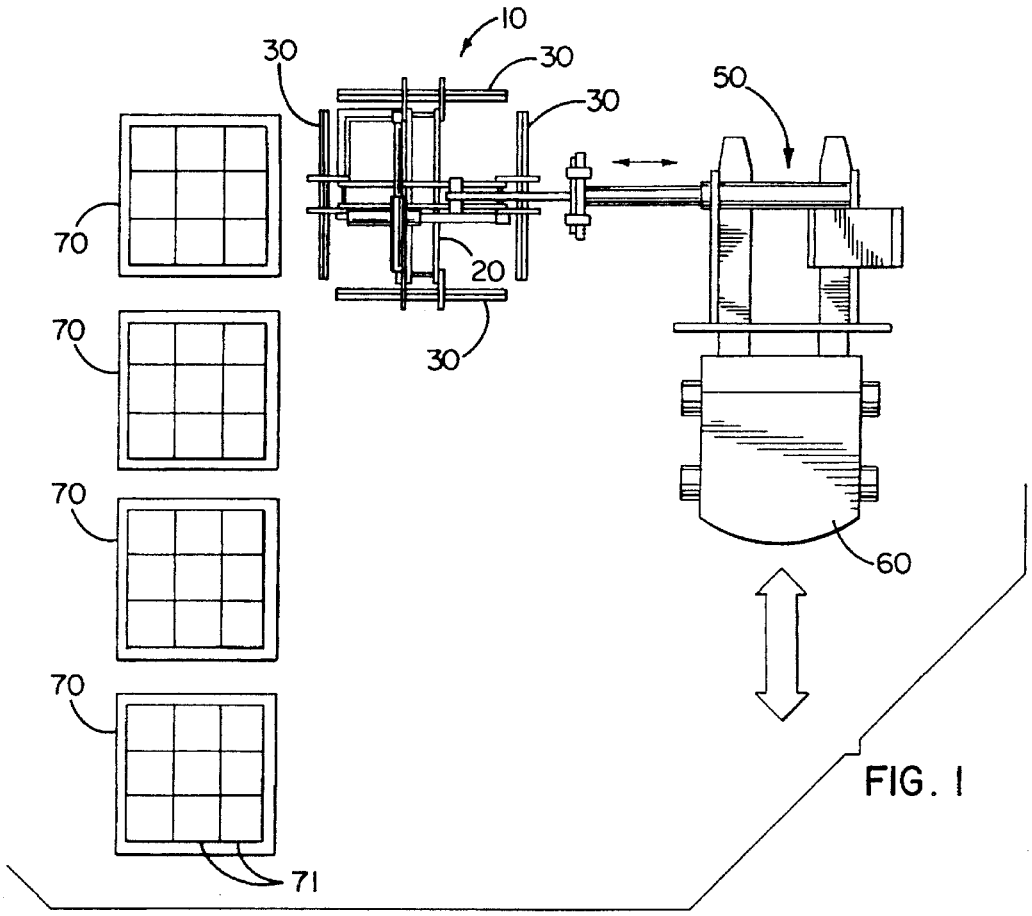
FIG. 1 is a plan view of an embodiment of a clamping apparatus according to the present invention.
Figure 2:
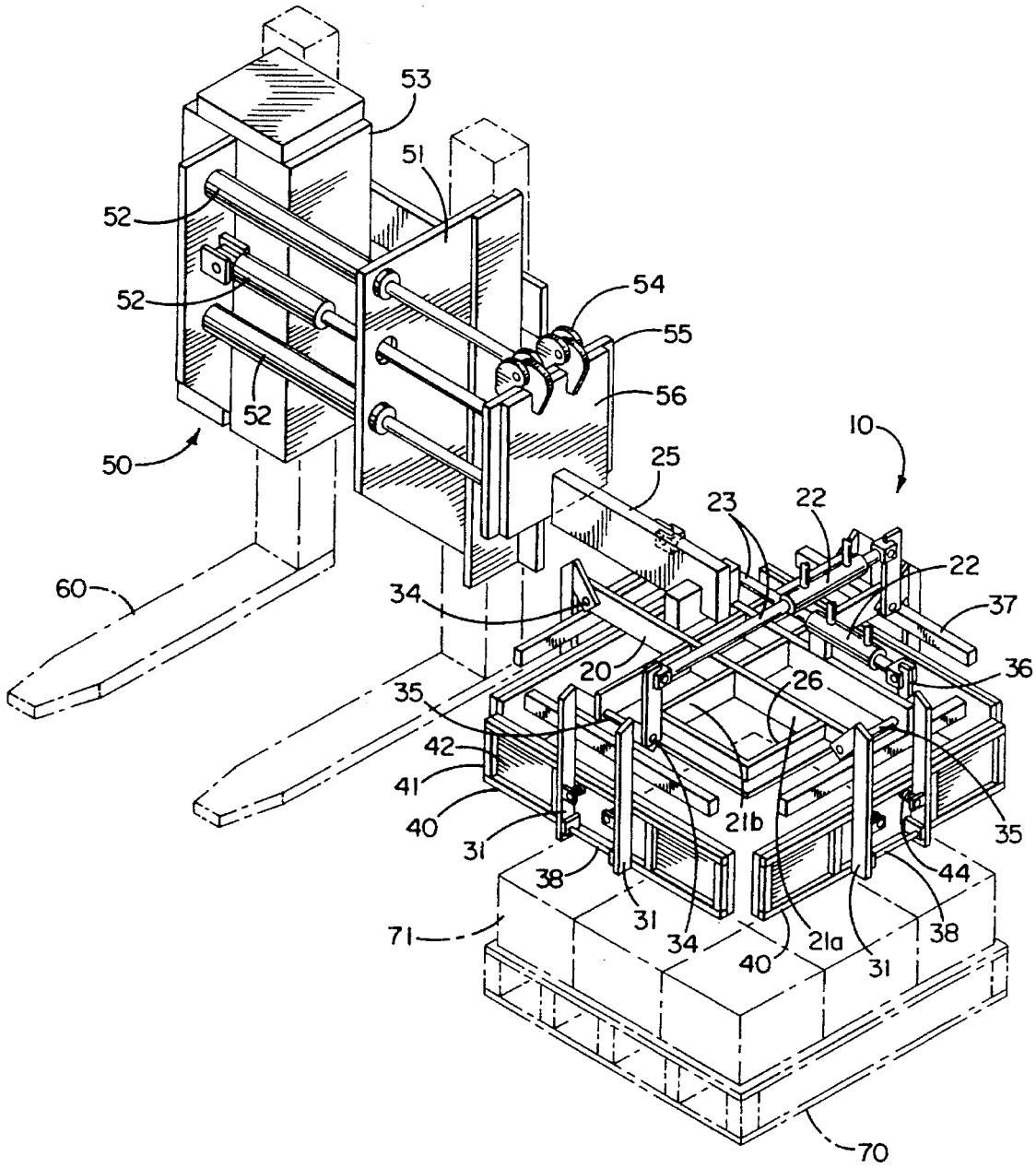
FIG. 2 is a perspective view of the embodiment of FIG. 1.

FIGS. 1–3 illustrate a preferred embodiment of a clamping apparatus according to the present invention. This embodiment will be described as used in handling cases of soft drink cans stacked in layers on pallets, but as described above, the apparatus can be used with a wide variety of objects.

As shown in these figures, the clamping apparatus includes a clamping portion 10 capable of grasping one or more layers of cases 71 of soft drink cans stacked on pallets 70, and a side shifter 50 which movably supports the clamping portion 10 on a fork lift 60. The side shifter 50 can move the clamping portion 10 in the lateral direction of the fork lift 60, which is to the left and right in FIG. 1.

The clamping portion 10 has a rigid frame 20 which pivotably supports four clamping arms 30 so as to define a four-sided space. The shape of the frame 20 is arbitrary, and in this embodiment it has the shape of a cross. The frame 20 is formed from a first pair of parallel plates 21*a* and a second pair of parallel plates 21*b* which crosses the first pair at 90 degrees angles and is rigidly secured to the first pair where the pairs intersect. Two of the clamping arms 30 are pivotably mounted in opposing relationship on the opposite ends of the first pair of plates 21*a* for pivoting about parallel horizontal axes, and the other two clamping arms 30 are pivotably mounted in opposing relationship on the opposite ends of the second pair of plates 21*b* for pivoting about parallel horizontal axes extending perpendicular to the axes of pivoting of the other two clamping arms 30.

The four clamping arms 30 need not be identical, but in the present embodiment they all have the same structure and substantially the same dimensions. As best shown in FIG. 3, each clamping arm 30 has a pair of support arms 31 pivotably secured to an end of the frame 20 at a pivot point 34, and a panel 40 supported by the lower end of the support arm 31. Each support arm 31 has a first section 32 pivotably connected to the frame 20 at one of the pivot points 34, and a second section 33 secured to and extending downward from the first section 32. A shaft 35 is secured to the first sections 32 of each pair of support arms 30 and is rotatably supported by holes in the plates 21*a*, 21*b* of the frame 20 at one of the pivot points 34. A lever arm 36 extends upwards from the first section 32 of one of the support arms 31 of each pair.

The first and second sections 32 and 33 of each support arm 31 may be separate members which are rigidly secured to each other, or they may be formed as a single member. The support arms 31 have been found to function particularly well when the two sections 32 and 33 form an acute angle where they intersect. Preferably, the angle is in the range of approximately 15 to approximately 80 degrees, and more preferably in the range of approximately 30 to approximately 60 degrees. For example, in the illustrated preferred embodiment, the angle between the first and second sections 32 and 33 of each support arm 31 is approximately 57 degrees. Therefore, when the second section 33 of a support arm 31 is vertical, the first section 32 extends diagonally upwards from pivot point 34 at an angle of approximately 57 degrees from the vertical. However, other shapes for the support arms 31 are possible. For example, the two sections 32 and 33 may define a right angle or obtuse angle. Alternatively, each support arm 31 may have the shape of an arc extending outwards from the corresponding pivot point 34.

The individual cases 71 of soft drink cans are generally rectangular, and are stacked on pallets 70 in layers which are either squares or elongated rectangles. The four panels 40 of the clamping arms 30 are used to grasp a layer of cases 71 from four sides at once. Preferably, the panels 40 are pivotable with respect to the support arms 31 about horizontal axes so that the opposing surfaces of the panels 40 can be maintained substantially vertical, even when the second sections 33 of the support arms 31 are sloped with respect to the vertical. Each panel 40 includes a rigid rectangular frame 41 and a resilient pad 42 of rubber or similar material mounted on the frame 41. To increase the gripping ability of the pad 42, its surface may be serrated or otherwise roughened. Each frame 41 is pivotably mounted about a pivot point 43 on a shaft 38 extending between the lower ends of the second sections 33 of a pair of the support arms 31. Preferably, the upper portion of the panel 40 is biased towards the second sections 33 of the support arms 31 by biasing springs 44 or other suitable biasing means. When a panel 40 contacts the surface of object to be lifted, the panel 40 can pivot about its pivot point 43 so that the surface of its pad 42 becomes parallel to the surface of the object. The length of each panel 40 is not critical but it preferably is no longer than the length of the side of a layer of cases 71 to be grasped by the panel 40.

The clamping arms 30 are pivoted about their respective pivot points 34 by drive members in the form of double-acting hydraulic cylinders 22. One end of each cylinder 22 is pivotably connected to one of the lever arms 36, and the drive rod 23 of the cylinder 22 is pivotably connected to the lever arm 36 at the opposite end of the frame 20. Other examples of suitable drive members which can be employed to pivot the clamping arms 30 are pneumatic cylinders and electric motors. Hydraulic cylinders are particularly suitable because the force which they exert can be easily regulated. Instead of double-acting hydraulic cylinders, single-acting cylinders with a return spring to retract the drive rod can also be employed. The cylinders 22 receive hydraulic fluid under pressure through unillustrated hydraulic lines connected to a conventional hydraulic controller mounted aboard the fork lift 60. The cylinders 22 are disposed at different heights so as not to interfere with each other. In FIG. 2, the cylinders 22 are disposed above the pivot points 34 so that cases 71 held by the clamping arms 30 can be stacked up to the bottom surface of the frame 20. However, the cylinders 22 may be installed in any location which enables them to exert a torque on the support arms 31 about the pivot points 34.

Instead of employing only two hydraulic cylinders 22, each clamping arm 30 can be equipped with its own hydraulic cylinder connected between the clamping arm 30 and the frame 20.

In order to assist the operator of the apparatus in aligning the clamping portion 10 with a layer of cases 71, an alignment guide 26 is mounted on one corner of the frame 20. The alignment guide 26 comprises plates joined to form a right angle corner extending between the plates 21*a* and 21*b*. The operator maneuvers the fork lift 60 and the side shifter 50 until the outer edges of the alignment guide 26 are aligned with the corner of a layer of cases 71. If desired, similar alignment guides 26 can be mounted on other corners of the frame 20. If the frame 20 is square or rectangular instead of cross shaped, the corners of the frame 20 can serve as alignment guides.

When the drive rod 23 of a cylinder 22 is retracted, the two clamping arms 30 connected to the cylinder 22 pivot about the pivot points 34 in a direction causing the panels 40 to move away from each other. Conversely, when the drive rod 23 of a cylinder 22 is extended, the two clamping arms 30 connected to the cylinder 22 pivot in a direction causing the panels 40 to move towards each other.

Generally, it is preferable for all four panels 40 to exert the same force on the object held between them. Equal forces can be readily obtained by suitably selecting the moment arms of the clamping arms 30 about the pivot point 34 and the hydraulic pressures in the cylinders 22. For example, if all four clamping arms 30 have the same moment arm and the same pressures are applied to both cylinders 22 so that both cylinders 22 exert the same force, the forces applied by the panels 40 from all four directions will be equal.

In order for the clamping arms 30 to hold a layer of cases 71 without any of the cases 71 falling down, the lateral forces exerted by the clamping arms 30 must generate frictional forces large enough to prevent slippage between the cases 71 and the pads 42, and between adjoining cases 71. Suitable lateral forces can be readily determined by experimentation. Furthermore, the lateral forces exerted by the clamping arms 30 are preferably low enough to prevent damage to the cases 71. The lateral forces which can safely be applied to various types of goods without damage are well known in the packaging industry, and the appropriate hydraulic pressure to obtain such forces can easily be calculated once the dimensions of the clamping arms 30 are known. The force to be applied will be such that the vertical component of the frictional force between the pads 42 and the sides of the layer or layers to be lifted is at least equal to the weight of the layer or layers. The hydraulic controller can then control the hydraulic pressures so as not to exceed the calculated levels.

When the apparatus is used to lift a stack of cases having a plurality of layers, the panels 40 will usually contact only the lowest layer in the stack. To prevent the upper layers from shifting due to the movement of the apparatus, side guards 37 can be secured to the support arms 31 or the frame 20.

The frame 20 is cantilevered from the side shifter 50 by a connecting arm 25 which is rigidly secured to the frame 20. The connecting arm 25 will usually extend parallel to one of the pairs of plates 21*a*, 21*b* of the frame 20 so that each panel 40 will be parallel to one of the sides of a layer of cases 71 to be lifted.

The frame 20 and the support arms 31 in this embodiment have fixed dimensions. However, both can be easily modified to have variable dimensions. For example, the frame 20 can be telescoping such that its width and length can be adjusted. Similarly, the second sections 33 of the support arms 31 may likewise be telescoping.

Figure 3A:
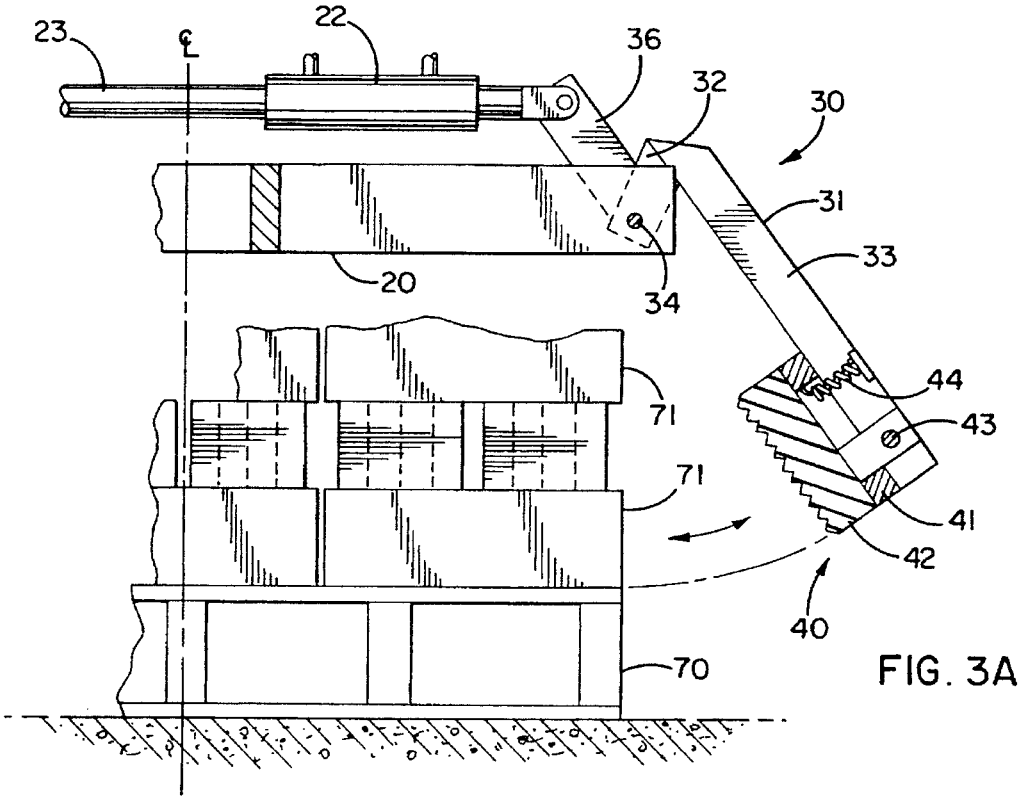
FIGS. 3A–3C are side elevations of one of the clamping arms of the embodiment of FIG. 1 at different angular positions.
Figure 3C:
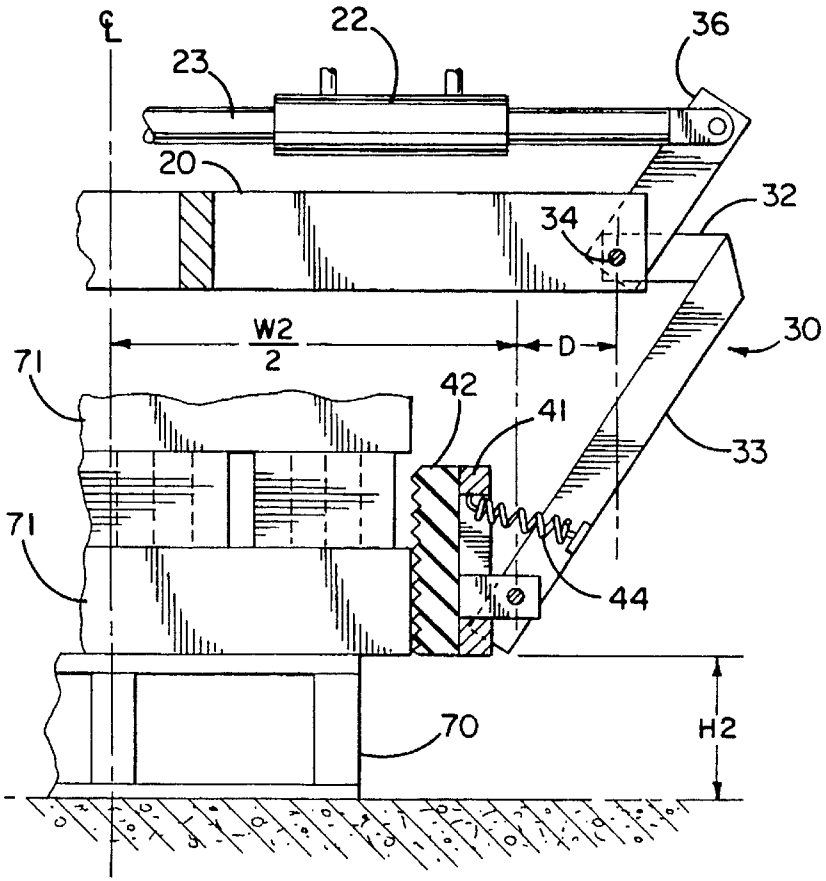
Figure 3B:
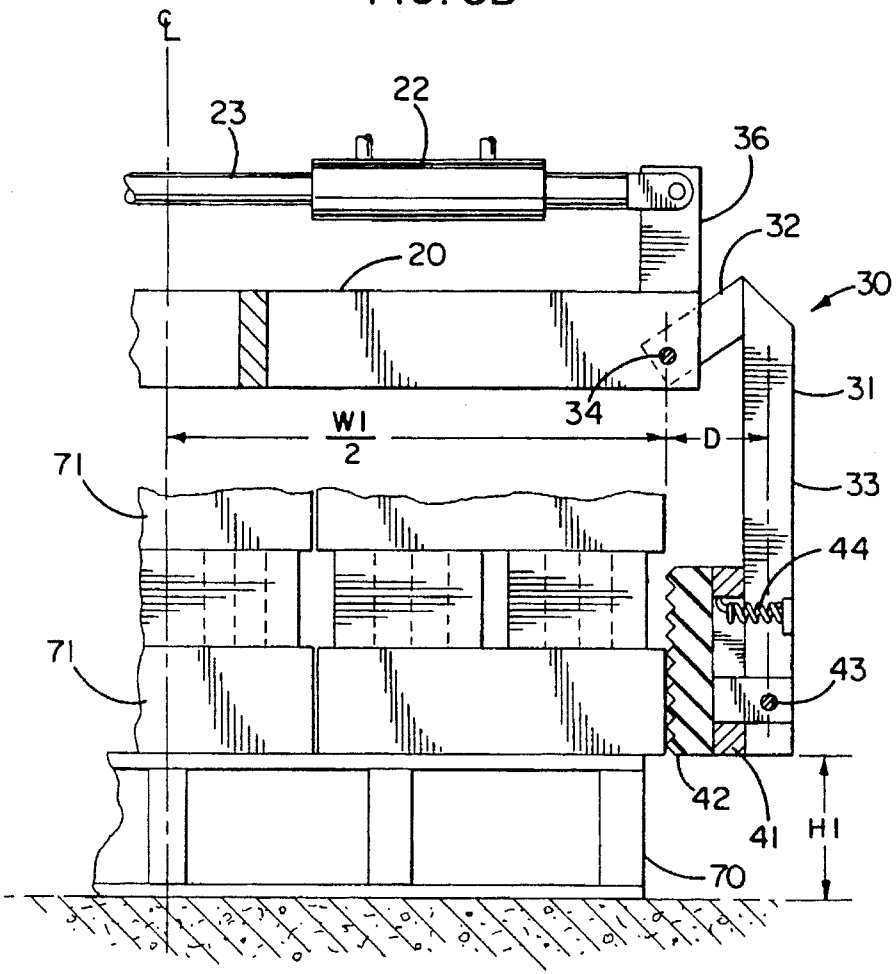

FIGS. 3A–3C illustrate one of the clamping arms 30 in various operational positions. In FIG. 3A, the clamping arm 30 is held by the corresponding cylinder 22 in a position such that the pad 42 of the panel 40 mounted on the support arm 31 is spaced from the sides of cases 71 stacked on a pallet 70. In this position, the clamping portion 10 can be raised and lowered without disturbing the cases 71. In FIG. 3B, the clamping arm 30 is shown pivoted to a position in which the pad 42 is pressed against the side of a layer of cases 71 having a total width W1. In FIG. 3C, the clamping arm 30 is pivoted to a position in which the pad 42 is pressed against the side of a layer of cases 71 having a total width W2 which is smaller than W1. The other support 31 to which the cylinder 22 is drivingly connected would appear, if shown, as a mirror image of the illustrated support arm 31.

Very often, a layer of cases 71 of soft drink can has rectangular dimensions, common dimensions being 32 inches by 38 inches. In order for the clamping arms 30 to reliably grasp the layer from all four sides, it is desirable that the pads 42 of all four clamping arms 30 be at substantially the same height, regardless of which side of the layer is being contacted. In other words, the height h1 of the lower edge of the pad 42 in FIG. 3B when opposing pads 42 are separated by 38 inches is preferably substantially the same as the height h2 of the lower edge of the pad 42 in FIG. 3C when opposing pads 42 are separated by 32 inches.

In the present embodiment, in order to make h1 substantially equal to h2, the dimensions of each support arm 31 are selected such that when opposing pads 42 are separated by 38 inches, the pivot point 43 for the panel 40 is offset by a distance D to the outside of a vertical line passing through pivot point 34 for the support arm 31, as shown in FIG. 3B. Furthermore, when opposing pads 42 are separated by 32 inches, pivot point 43 is offset by the same distance D to the inside of a vertical line passing through pivot point 34, as shown in FIG. 3C. For example, in the present embodiment, the offset D is 3 inches. Even though the support arm 31 pivots about pivot point 34 from the position shown in FIG. 3B to the position shown in FIG. 3C and the pivot point 43 of the panel 40 travels along an arc centered on pivot point 34, the starting and ending heights h1 and h2 of pivot point 43 are the same, so the effect is as if the pads 42 were moved horizontally from a separation of 38 inches to a separation of 32 inches. Accordingly, the four pads 42 of the four clamping arms 30 can grasp the four sides of a layer at substantially the same height, even when the layer is an elongated rectangle.

Ideally, h1 and h2 are identical. Because of manufacturing tolerances, there may be some small differences between the two heights. However, it has been found that the clamping portion 10 can securedly grasp a layer of cases 71 of soft drink cans when h1 and h2 differ by up to 1 inch.

Since the panels 40 are pivotable about pivot points 43, they can always remain parallel to the sides of the layer which is to be lifted.

When the layer to be lifted is perfectly square, all four panels 40 will of course contact the layer at exactly the same height, regardless of the dimensions of the layer.

In this embodiment, a layer having dimensions differing by 6 inches can be reliably clamped at a uniform height. If the length and width of a layer to be lifted differ from one another by a different amount, the arc along which the pivot point 43 swings can be selected so that the height of the pads 42 will remain the same at the minimum and maximum dimensions of the layer.

The side shifter 50 is adapted to be mounted on the front of the fork lift 60 by any suitable means, such as by bolts. Alternatively, it can be mounted on a different type of lifting mechanism, such as a gantry crane or a robot arm. The side shifter 50 includes a frame 51 and one or more drive members for moving the clamping portion 10 in the lateral direction of the fork lift 60. The drive members in this embodiment are double-acting hydraulic cylinders 52, but other types of drive members can be employed, such as pneumatic cylinders or electric motors with linearly moving output shafts. A counterweight 53 can be mounted on the frame 51 to balance the weight of the clamping portion 10 and the load which it holds. The fluid pressure supplied to the hydraulic cylinders 52 can be regulated by a conventional hydraulic controller aboard the fork lift 60.

The side shifter 50 may be rigidly connected to the clamping portion 10, but preferably the two are connected by a joint which allows at least a small amount of relative vertical movement between them. In FIG. 2, such a joint comprises a hinge 54 connected between the upper portions of two vertical plates 55 and 56. One plate 55 is secured to the outer ends of the hydraulic cylinders 52 of the side shifter 50, and the other plate 56 is secured to the connecting arm 25 of the clamping portion 10.

When the clamping portion 10 is lowered onto a pallet or other solid surface, it is difficult for the operator of the fork lift 60 to stop the downwards movement of the fork lift 60 as soon as contact between the clamping portion 10 and the pallet takes place. If there is a rigid connection between the clamping portion 10 and the side shifter 50, the downward movement of the entire clamping apparatus will suddenly stop when the contact takes place, and undesirable slack will developed in the chains and hydraulic lines of the fork lift 60. In contrast, when a movable joint like that illustrated in FIG. 2 is employed, when the downward movement of the clamping portion 10 is stopped by contact with a pallet, the side shifter 50 can continue to move slightly downward with the fork lift 60 as the plates 55 and 56 pivot about the axis of the hinge 54. As a result, the chains and hydraulic lines in the fork lift 60 are maintained taut.

Figure 4:
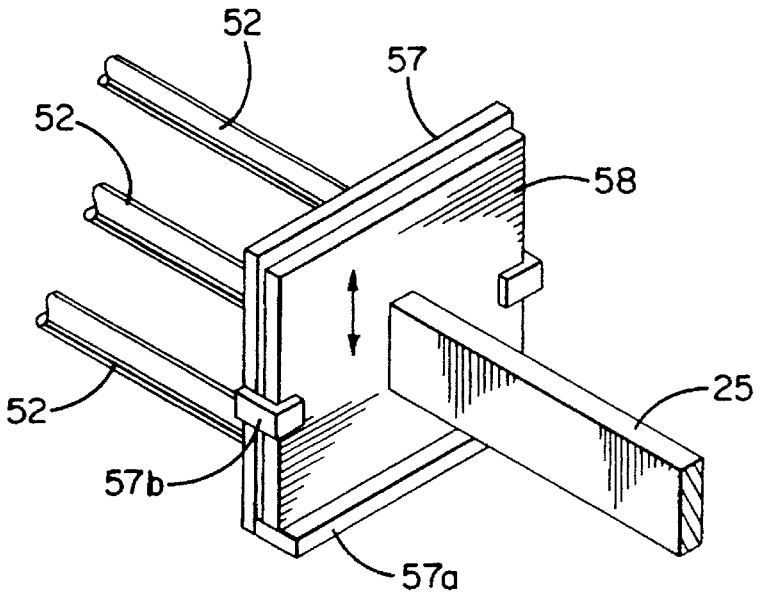
FIG. 4 is a perspective view of a variation of the joint for connecting the clamping portion to the side travel portion.

FIG. 4 illustrates another example of a joint for connecting the side shifter 50 to the clamping portion 10. In this example, a plate 57 connected to the cylinders 52 of the side shifter 50 slidably supports a plate 58 connected to the connecting arm 25 of the clamping portion 10 for vertical movement. A lower ledge 57*a* on plate 57 supports the weight of plate 58 and of the clamping portion 10, and guides 57*b* slidably guide the lateral edges of plate 58. When the clamping portion 10 is lowered onto a pallet which prevents its further downwards movement, the side shifter 50 can continue to move slightly downwards with the fork lift 60 as the two plates 57 and 58 slide with respect to each other, thereby maintaining the chains and hydraulic lines in the fork lift 60 taut.

The side shifter 50 of this embodiment moves the clamping portion 10 in the lateral direction of the fork lift 60, but it may be modified so as to move the clamping portion 10 in the fore and aft direction of the fork lift 60. It is also possible to omit the side shifter 50 and mount the clamping portion 10 directly on the fork lift 60, preferably employing a movable joint, such as the hinge 54 of FIG. 2 or the joint shown in FIG. 4.

In order to operate the embodiment of FIG. 1, the operator of the fork lift 60 drives the fork lift 60 until the clamping portion 10 is disposed opposite a pallet 70 containing cases 71 which are to be moved. The operator then uses the side shifter 50 to maneuver the clamping portion 10 until it is directly above the top layer of cases 71 on the pallet 70. The clamping portion 10 is then lowered by means of the fork lift 60 until the pads 42 of the clamping arms 30 are disposed opposite the sides of the lowest layer of cases 71 to be lifted. At this time, the clamping arms 30 are in an outwardly pivoted position, as shown in FIG. 3A, so that the pads 42 will not strike the cases 71 as the clamping portion 10 is being lowered. The hydraulic cylinders 22 are then operated to pivot the clamping arms 30 inwards until each of the four pads 42 is pressed against one of the sides of a layer with a predetermined force, as shown in FIG. 3B or 3C. When the pressure in each cylinder 22 reaches a predetermined value, the hydraulic controller maintains the pressure at that value so that the layer is securely held by the clamping arms 30 without being crushed. The fork lift operator then raises the clamping portion 10 by means of the fork lift 60, and the layer of cases 71 grasped by the clamping arms 30 and any layers stacked above that layer are lifted off the pallet 70 to be moved by the fork lift 60 to a desired location and lowered onto a different pallet 70. Once the layer or layers of cases 71 held by the clamping arms 30 are stably disposed on the different pallet 70, the clamping arms 30 are swung outwards as shown in FIG. 3A to release the cases 71.

In contrast to a manual worker who can transfer cases between pallets only one case at a time, a clamping apparatus according to the present invention can move entire layers of cases at a time, so productivity is enormously increased. For example, it is expected that an average fork lift operator can move over 2000 cases per hour using the clamping apparatus according to the present invention, which is four times the rate that a typical worker can move cases by hand. Furthermore, since all lifting is done by the clamping apparatus and the fork lift, injuries to workers resulting from lifting cases by hand for long periods can be greatly reduced.

Figure 5:
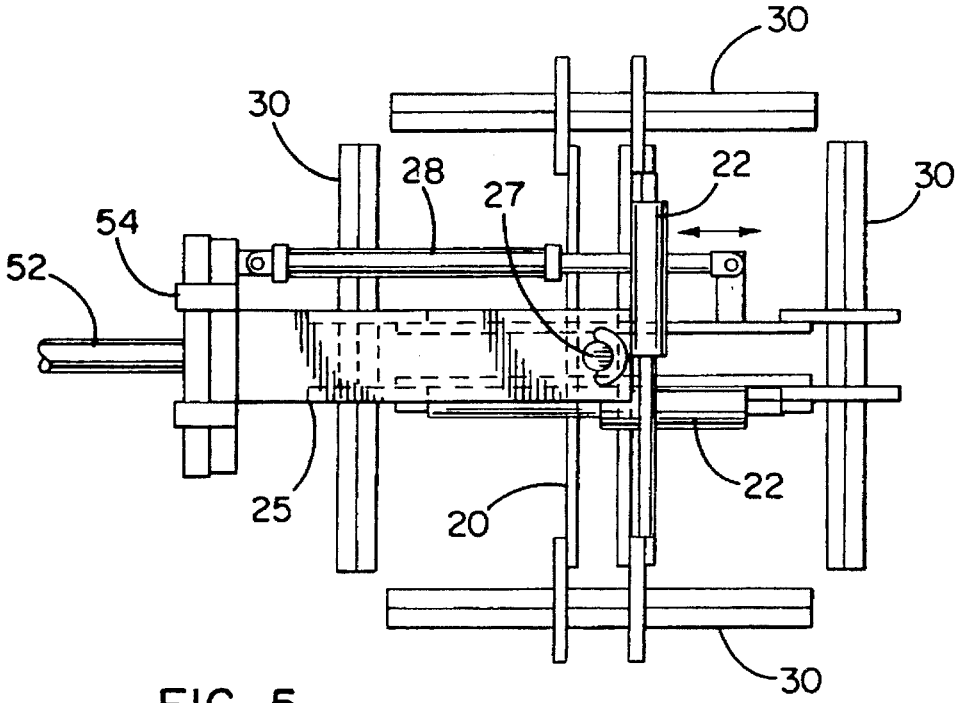
FIG. 5 is a plan view of an embodiment in which the frame of the clamping portion can pivot about a vertical axis.

In the embodiment of FIG. 1, the orientation of the frame 20 with respect to the fork lift 60 is fixed. In some instances, however, it is useful to be able to rotate an entire layer of cases on a pallet in order to access cases located in the rear of the layer. FIG. 5 illustrates an embodiment of the present invention in which the frame 20 of the clamping portion 10 can be rotated about a vertical axis passing through the center of the frame 20 while the clamping portion 10 is supporting a layer. The frame 20 is rotatably supported by the connecting arm 25 for rotation about a pivot point 27. The rotational position of the frame 20 can be adjusted by a hydraulic cylinder 28 or other suitable drive member rotatably connected at its ends between the connecting arm 25 and the frame 20. When the output shaft of the cylinder 28 is extended or retracted, the frame 20 is rotated by 90 degrees in the counterclockwise or clockwise directions, respectively, in the figure.

In the above-described embodiment, all four of the clamping arms 30 are pivotably supported for pivoting about a horizontal axis. However, it is also possible for one clamping arm 30 of each pair of opposing clamping arms 30 to be fixed, and for only the opposing clamping arm 30 of each pair to be pivotable.

When the clamping apparatus is used to lift a plurality of unconnected objects, such as a layer of cases 71, it is usually desirable to grasp the objects with the clamping arms 30 from all four sides. However, if the objects are rigidly connected together, or if there is only a single large object to be lifted, it may be possible to lift the object with only a single pair of clamping arms 30 grasping the object along two opposing sides. Therefore, in such a situation, it is possible for a clamping apparatus according to the present invention to have only two clamping arms 30.

In the illustrated embodiment, the soft drink cans are housed in cases 71. However, since the clamping arms 30 can apply a uniform pressure from four sides simultaneously, the clamping apparatus could also be used to lift a plurality of loose cans or bottles, not disposed in cases.

What is claimed is:

1. A clamping apparatus comprising:

a frame;

first and second opposing clamping arms pivotably supported by the frame for pivoting about parallel first and second horizontal axes, respectively, each clamping arm including a support arm and a contact portion for contacting an object to be lifted, each support arm having a first section pivotably connected to the frame at a pivot point and a second section extending downwards from a portion of the first section spaced from the pivot point at an acute angle with respect to the first section, the contact portion being supported by the second section; and one or more drive members connected to the first and second clamping arms to pivot the first and second clamping arms about the first and second axes.

2. An apparatus according to claim 1 wherein the angle is in the range of approximately 15 to approximately 80 degrees.

3. An apparatus according to claim 1 wherein the angle is in the range of approximately 30 to approximately 60 degrees.

4. An apparatus according to claim 1 wherein the height of the contact portions relative to a horizontal plane when spaced apart by a first separation differs by at most one inch from the height of the contact portions relative to the horizontal plane when spaced apart by a second separation smaller than the first separation by approximately 6 inches.

5. An apparatus according to claim 4 wherein the first separation is approximately 38 inches and the second separation is approximately 32 inches.

6. An apparatus according to claim 5 wherein the height of the contact portions when spaced by the first separation is substantially identical to the height of the contact portions when spaced by the second separation.

7. An apparatus according to claim 4 wherein the second sections are oriented vertically when the contact portions are spaced apart by the first separation and are sloped with respect to the vertical when the contact portions are spaced apart by the second separation.

8. An apparatus according to claim 1 wherein each contact portion comprises a pad pivotably supported by one of the support arms for pivoting about a horizontal axis.

9. An apparatus according to claim 8 wherein each pad has serrations on a surface thereof.

10. An apparatus according to claim 1 wherein the frame is pivotable about a vertical axis, the apparatus including a drive member connected to the frame for pivoting the frame about the vertical axis.

11. An apparatus according to claim 1 including a side shifter connected to the frame for moving the frame horizontally.

12. An apparatus according to claim 11 including a movable joint connecting the side shifter to the frame to permit relative vertical movement of the side shifter and the frame.

13. An apparatus according to claim 12 wherein the movable joint comprises a hinge connected between the side shifter and the frame.

14. An apparatus according to claim 12 wherein the movable joint connects the side shifter and the frame for relative vertical sliding movement.

15. An apparatus according to claim 1 further including third and fourth opposing clamping arms pivotable about third and fourth parallel axes, respectively, extending perpendicular to the first and second axes, each of the third and fourth clamping arms including a support arm and a contact portion, each support arm having a first section pivotably connected to the frame at a pivot point and a second section extending downwards from a portion of the first section spaced from the pivot point at an acute angle with respect to the first section, the contact portion being supported by the second section.

16. An apparatus according to claim 15 wherein:

the frame is cross-shaped and has first and second intersecting frame members;

the first and second clamping arms are pivotably supported by opposite ends of the first frame member; and the third and fourth clamping arms are pivotably supported by opposite ends of the second frame member.

17. An apparatus according to claim 16 wherein the first and second frame members intersect at right angles.

18. An apparatus according to claim 16 wherein each frame member comprises a pair of parallel plates.

19. An apparatus according to claim 1 including an alignment guide secured to the frame for aligning the frame with respect to a surface to be contacted by one of the contact portions of an object to be lifted.

20. An apparatus according to claim 19 wherein the alignment guide defines a corner for alignment with a corner of an object to be lifted.

21. An apparatus according to claim 19 wherein the alignment guide is substantially L-shaped.

22. An apparatus according to claim 1 wherein the first section of each support arm has first and second ends, the first end being proximate the pivot point and the second end being connected to the second section of the support arm.

23. An apparatus according to claim 22 wherein the first section extends upwards from the pivot point to the second end of the first section.

24. A system for lifting an object comprising:

a clamping device comprising a frame, first and second opposing clamping arms pivotably supported by the frame about first and second parallel axes, respectively, and having first and second contact portions, respectively, for grasping an object, and one or more drive members operatively connected to the first and second clamping arms to pivot the first and second clamping arms about the first and second axes;

a fork lift;

a side shifter mounted on the fork lift for moving the clamping device in a transverse direction of the fork lift; and a joint connecting the side shifter and the clamping device to permit relative vertical movement of the side shifter and the clamping device upon impact of the clamping device against an object.

25. A system according to claim 24 wherein the joint comprises a hinge pivotable about a horizontal axis and connected between the side shifter and the clamping device.

26. A system according to claim 24 wherein the joint connects the side shifter and the clamping device for relative vertical sliding movement.

27. A clamping apparatus for use in lifting an object comprising:

a support frame;

a first pair of opposing clamping arms pivotably supported by the frame for pivoting about a first pair of parallel axes separated by a first distance, and a second pair of opposing clamping arms pivotably supported by the frame for pivoting about a second pair of parallel axes separated by the first distance and extending perpendicular to the first pair of parallel axes, each clamping arm having a first section with a lower portion pivotable about one of the axes and an upper portion extending upwards from the lower portion, a second section extending downwards from the upper portion of the first section at an angle in the range of approximately 15 to approximately 80 degrees, and a contact portion mounted on a lower portion of the second section; and one or more drive members connected to the clamping arms to pivot the clamping arms about the two pairs of axes and press the contact portions against an object with a force sufficient for the contact portions to support the weight of the object, wherein the lower portion of the second section of each clamping arm is movable along a corresponding arc centered on one of the axes between a first point at which the contact portion of each clamping arm is separated from the contact portion of the opposing clamping arm by approximately 32 inches, and a second point at which the contact portion of each clamping arm is separated from the contact portion of the opposing clamping arm by approximately 38 inches, the lower portion of each clamping arm being at a minimum height of the corresponding arc between the first and second points.

28. An apparatus according to claim 27 wherein the height with respect to a horizontal plane of an opposing pair of the contact portions when separated by approximately 32 inches is substantially identical to the height of the opposing pair of contact portions when separated by approximately 38 inches.

* * * * *